US008781133B2

(12) United States Patent
Walther et al.

(10) Patent No.: US 8,781,133 B2
(45) Date of Patent: Jul. 15, 2014

(54) APPARATUS FOR GENERATING A MULTI-CHANNEL AUDIO SIGNAL

(75) Inventors: Andreas Walther, Crissier (CH); Oliver Hellmuth, Erlangen (DE); Falko Ridderbusch, Nuremberg (DE); Christian Stoecklmeier, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 340 days.

(21) Appl. No.: 13/155,477

(22) Filed: Jun. 8, 2011

(65) Prior Publication Data

US 2011/0261967 A1 Oct. 27, 2011

Related U.S. Application Data

(63) Continuation of application No. PCT/EP2008/010553, filed on Dec. 11, 2008.

(51) Int. Cl.
*H04R 5/00* (2006.01)

(52) U.S. Cl.
USPC ..... 381/17; 381/18

(58) Field of Classification Search
USPC ..... 381/307, 310, 17–18, 119; 700/94; 704/502
See application file for complete search history.

(56) References Cited

U.S. PATENT DOCUMENTS

| | | | | |
|---|---|---|---|---|
| 5,870,480 | A | 2/1999 | Griesinger | |
| 6,937,737 | B2 | 8/2005 | Polk, Jr. | |
| 7,412,380 | B1 | 8/2008 | Avendano et al. | |
| 7,809,580 | B2 | 10/2010 | Hotho et al. | |
| 2007/0041592 | A1 | 2/2007 | Avendano et al. | |
| 2007/0242833 | A1 * | 10/2007 | Herre et al. | 381/61 |
| 2008/0152155 | A1 | 6/2008 | Avendano et al. | |
| 2008/0205676 | A1 * | 8/2008 | Merimaa et al. | 381/310 |
| 2008/0232617 | A1 | 9/2008 | Goodwin et al. | |

FOREIGN PATENT DOCUMENTS

| | | | |
|---|---|---|---|
| EP | 2 154 911 | A1 | 2/2010 |
| RU | 2 364 053 | C2 | 12/2007 |
| RU | 2007 120 528 | A | 12/2008 |

(Continued)

OTHER PUBLICATIONS

Official Communication issued in International Patent Application No. PCT/EP2008/010553, mailed on Oct. 2, 2009.

(Continued)

*Primary Examiner* — Vivian Chin
*Assistant Examiner* — Ammar Hamid
(74) *Attorney, Agent, or Firm* — Keating & Bennett, LLP

(57) ABSTRACT

An apparatus for generating a multi-channel audio signal based on an input audio signal comprises a main signal upmixer, a section selector, a section signal upmixer and a combiner. The main signal upmixer is configured to provide a main multi-channel audio signal based on the input audio signal. The section selector is configured to select or not select a section of the input audio signal based on an analysis of the input audio signal. The selected section of the input audio signal, a processed selected section of the input audio signal or a reference signal associated with the selected section of the input audio signal is provided as section signal. The section signal upmixer is configured to provide a section upmix signal based on the section signal, and the combiner is configured to overlay the main multi-channel audio signal and the section upmix signal to obtain the multi-channel audio signal.

12 Claims, 8 Drawing Sheets

(56) References Cited

FOREIGN PATENT DOCUMENTS

| | | | | |
|---|---|---|---|---|
| WO | 01/62045 | A1 | | 8/2001 |
| WO | 02/052896 | A2 | | 7/2002 |
| WO | 2005/101905 | A1 | | 10/2005 |
| WO | WO 2005101905 | A1 | * | 10/2005 |
| WO | 2006/108573 | A1 | | 10/2006 |
| WO | 2008/046530 | A2 | | 4/2008 |
| WO | 2008/049587 | A1 | | 5/2008 |
| WO | 2008/111770 | A1 | | 9/2008 |
| WO | WO 2008111770 | A1 | * | 9/2008 |

OTHER PUBLICATIONS

Wagner et al., "Generation of Highly Immersive Atmospheres for Wave Field Synthesis Reproduction", Audio Engineering Society Convention, Convention Paper 6118, May 2004, 9 pages, Berlin, Germany.

Hotho et al., "Multichannel Coding of Applause Signals", EURASIP Journal on Advances in Signal Processing, vol. 2008, 9 pages.

Goodwin et al., "Frequency-Domain Algorithms for Audio Signal Enhancement Based on Transient Modification", Journal Audio Engineering Society, vol. 54, No. 9, Sep. 2006, pp. 827-840.

* cited by examiner

APPARATUS FOR GENERATING A MULTI-CHANNEL AUDIO SIGNAL

CROSS-REFERENCE TO RELATED APPLICATIONS

This application is a continuation of copending International Application No. PCT/EP2008/010553, filed Dec. 11, 2008, which is incorporated herein by reference in its entirety.

BACKGROUND OF THE INVENTION

Embodiments according to the invention relate to an apparatus and a method for generating a multi-channel audio signal based on an input audio signal.

Some embodiments according to the invention relate to an audio signal processing, especially related to concepts for generating multi-channel signals, wherein not for each loudspeaker an own signal was transmitted.

When a signal with N audio channels is reproduced by an audio system with M reproduction channels (M>N), for example, the following possibilities exist:

1) Only a part of the available loudspeakers are used

2) A signal is generated, which makes use of the complete available reproduction system.

The second possibility is the favourable solution and is also called upmix in the following text.

In the context of upmixing there are two different kinds of methods for generating a multi-channel signal. For example, an existing multi-channel signal is summed up to a smaller number of channels in order to regenerate the original signal at the receiver based on additional data. This method is also called guided upmix.

The other possibility is a so-called blind upmix method. This concerns a multi-channel extension without previous knowledge. There is no additional data that controls the process. There is also no original sound impression or reference sound impression, which has to be reproduced or reached by the blind upmix.

Therefore, different approaches for realizing a blind upmix exist.

One possible approach is known as direct ambience concept. In this case, direct sound sources are reproduced by the three front channels (for example, for a so-called 5.1 home cinema system), so that the direct sound sources are heard by a listener at the same positions as in the original two-channel version (for example, when the input signal is a stereo signal).

FIG. 2 shows a schematic illustration of an audio signal reproduction 200 for a two-channel system. An original two-channel version is shown, for example, with three direct sound sources S1, S2, S3, 240. The audio signal is reproduced for a listener 210 by a left loudspeaker 220 and a right loudspeaker 230 and comprises signal portions of the three direct sound sources and an ambience portion 250 indicated by the encircled area. This is, for example, a standard two-channel stereo reproduction (3 sources and ambience).

FIG. 3 shows a schematic illustration of an audio signal reproduction 300 of a blind upmix according to the direct ambience concept. Five loudspeakers (center 310, front left 320, front right 330, rear left 340 and rear right 350) are shown for reproducing a multi-channel audio signal.

Direct sound sources 240 are reproduced by the three loudspeakers 310, 320, 330 in front. Ambience portions 250 contained in the audio track are reproduced by the front channels and the surround channels in order to envelope a listener 210.

Ambience portions are portions of the signal, which cannot be assigned to a single source, but are assigned to a combination of all sound components, which create an impression of the audible environment. Ambience portions may comprise, for example, room reflections and room reverberations, but also sounds of the audience, for example applause, natural sounds, for example rain or artificial sound effects, for example vinyl cracking sound.

A further possible concept is often mentioned as in-the-band concept. FIG. 4 shows a schematic illustration of an audio signal reproduction 400 according to the in-the-band concept. The arrangement of the loudspeakers corresponds to the arrangement of the loudspeakers in FIG. 3. However, each sound type, for example, direct sounds sources and ambience-like sounds are positions around the listener.

Since all output signals are generated from the same input signal, the output signals should be further decorrelated. For this, many known methods may be used, as for example temporal delay or the use of an all-pass filter. The mentioned simple methods often show additionally to the decorrelation effect disturbing drawbacks.

For example, one drawback is that nearly all decorrelation methods distort the temporal structure of the input signals, so that transient structures lose their transient character. This leads for example to the effect, that an applause-like ambience signal may only reach an enveloping effect, but no immersion.

Special signal types, such as applause or rain, take an exceptional position among the ambience signals. They are ambience signals, which do not necessarily give a room impression. They rather create an enveloping feeling by the vast number of temporal and spatial overlays of single portions, which comprise for their own direct sound character, as for example single claps or single raindrops. By the overlay, the resulting overall signal gets mainly the same statistical properties as known from room reverberation.

Especially these signal types are difficult to handle with an upmix method (by guided upmix as well as by blind upmix). Also, they often lead to a faulty upmix, for example, often a comb filter like effect can be heard.

Known blind upmix methods, which create the signal portions for the rear channels, so that these artifacts do not take place, generate a sound impression, that is limited to an impression, for example, where the audience claps in front of the listener and the surround channels only generate an impression of the room in which the applause takes place (enveloping ambience). But especially in these ambiences it is desirable to be a part of the clapping audience or to stay in the rain (immersive ambience). For this, all portions (similar to the in-the-band concept) should be distributed around the listener, but without any measures this would lead once again to a sound impression with artifacts.

In "A. Wagner, A. Walther, F. Melchior, M. Strauβ; "Generation of Highly Immersive Atmospheres for Wave Field Synthesis Reproduction"; Presented at the AES 116$^{th}$ Convention, Berlin, 2004" a method is described how an immersive ambience may be generated for a wave field synthesis. For that, a listener is surrounded by a 360° decorrelated, enveloping sound field, which gives an impression of the represented acoustic environment.

To reach an immersion effect, so-called focused sources are added. A focused source is a point sound source, which is perceptible as a single source and represents characteristic single sounds of the enveloping sound field.

According to the publication, single sources (sound particles) have to be available for each ambience in large numbers and may either be separately recorded sounds or artificial sounds generated by a synthesizer.

This object-oriented approach has the drawback that different audio signals for each ambience type should already be available. At one hand, the enveloping ambience signals as decorrelated single tracks, at the other hand, the single sound sources as separate audio files. A mentioned alternative is to generate (for example with a synthesizer software) these for each ambience type (if it is know) artificially, which includes the risk, that they do not fit to the reproduced ambience. Additionally, for such a generation, for example, a mathematical model of the particle sounds and a lot of computing time is needed. In general, the effort for a wave field synthesis is very high.

In "Gerard Hotho; Steven van de Par; Jeroen Breebart; "Multichannel Coding of Applause Signals"; Research Article" a method for multi-channel coding of applause signals is described, which especially includes a method for a decorrelation of random ambiences (called: applause, rain, crackling).

Here, it is mentioned, that a frequency-selective coder makes the quality of the signals worse and therefore an only time domain-based coder is presented.

In this connection only a decorrelation should be made, which means basically all signals sound equal (or as at the input). A decorrelation method is introduced with which a reproduction of a reference sound should be successful.

In an earlier non-prepublished european patent application with the application number EP 08018793 a method is introduced which decomposes an applause-like signal into a foreground sound and a background sound. Reference is also made to "A. Wagner, A. Walther, F. Melchior, M. Strauβ; "Generation of Highly Immersive Atmospheres for Wave Field Synthesis Reproduction"; Presented at the AES 116$^{th}$ Convention, Berlin, 2004". An enveloping ambience is separated from the perceptible single sounds, from which the ambience consists of, and then these two parts can be handled separated from each other.

In the mentioned non-prepublished patent application a method is described including one embodiment (guided mode) trying to reproduce the original ambience. In principle, the background sounds (different than the foreground sounds) are only decorrelated and the foreground sounds are only placed at different times at different positions. It may be said that it only concerns a decorrelation method.

The overall signal is decomposed in a foreground and a background. It can be assumed that only a common reproduction of the separated parts will again sound good, but both themselves may comprise artifacts.

Further known upmix methods are described for example in "Roy Irwan and Ronaldus Aarts, "Multi-Channel Audio Converter", International Publication Number: WO 02/052896 A2", in "Carlos Avendano and Jean-Marc Jot, "Stream Segregation For Stereo Signals", Pub. No. US 2007/0041592 A1", in "David Griesinger, "Multichannel Active Matrix Encoder And Decoder With Maximum Lateral Separation", Patent Number US005870480A" and in "Jan Petersen, "Multi-Channel Sound Reproduction System For Stereophonic Signals", International Publication Number WO 01/62045 A1", which do not differentiate between different input signals.

SUMMARY

According to an embodiment, an apparatus for generating a multi-channel audio signal based on an input audio signal may have: a main signal upmixing means configured to provide a main multi-channel audio signal based on the input audio signal, wherein the main multi-channel audio signal comprises more channels than the input audio signal; a section selector configured to select or not select a section of the input audio signal based on an analysis of the input audio signal, wherein the selected section of the input audio signal, a processed selected section of the input audio signal or a reference signal associated with the selected section of the input audio signal is provided as section signal, wherein the section selector selects a section of the input audio signal by a separation of a sound particle; a section signal upmixing means configured to provide a section upmix signal based on the section signal, wherein the section signal upmixing means generates the section upmix signal containing more than one sound particle; and a combiner configured to overlay the main multi-channel audio signal and the section upmix signal to obtain the multi-channel audio signal, wherein the section signal upmixing means is configured to provide the section upmix signal based on a position parameter, wherein a portion of the multi-channel audio signal, which is based on the section signal, for each channel of the multi-channel audio signal is based on the position parameter.

According to another embodiment, a method for generating a multi-channel audio signal based on an input audio signal may have the steps of: providing a main multi-channel audio signal based on the input audio signal, wherein the main multi-channel audio signal comprises more channels than the input audio signal; selecting or not selecting a section of the input audio signal based on an analysis of the input audio signal, wherein the selected section of the input audio signal, a processed selected section of the input audio signal or a reference signal associated with the selected section of the input audio signal is provided as section signal, wherein selecting a section of the input audio signal is done by a separation of a sound particle; generating a section upmix signal containing more than one sound particle based on the section signal; providing the section upmix signal; and overlaying the main multi-channel audio signal and the section upmix signal to obtain the multi-channel audio signal, wherein the section upmix signal is provided based on a position parameter, wherein a portion of the multi-channel audio signal, which is based on the section signal, for each channel of the multi-channel audio signal is based on the position parameter.

Another embodiment may have a computer program with a program code for performing the inventive method, when the computer program runs on a computer or a microcontroller.

An embodiment of the invention provides an apparatus for generating a multi-channel audio signal based on an input audio signal. The apparatus comprises a main signal upmixing means, a section selector, a section signal upmixing means and a combiner.

The main signal upmixing means is configured to provide a main multi-channel audio signal based on the input audio signal.

The section selector is configured to select or not select a section of the input audio signal based on an analysis of the input audio signal. The selected section of the input audio signal, a processed selected section of the input audio signal or a reference signal associated with the selected section of the input audio signal is provided as section signal.

The section signal upmixing means is configured to provide a section upmix signal based on the section signal, and the combiner is configured to overlay the main multi-channel audio signal and the section upmix channel to obtain the multi-channel audio signal.

Embodiments according to the present invention are based on the central idea that the main multi-channel audio signal generated by the main signal upmixing means is upgraded by an additional audio signal in terms of the section upmix signal. This additional audio signal is based on a selection of a section of the input audio signal.

The multi-channel audio signal may be influenced in a very flexible way by the section selector and the section signal upmixing means.

Due to the improved flexibility and by using a smart selection of the section signal and a suitable section signal upmixing rule, the sound quality may be improved.

Since the multi-channel audio signal is an artificial signal anyway, because it is generated based on the input audio signal with less channels than the multi-channel audio signal, and does not provide the original sound impression, the sound quality of the multi-channel audio signal may be improved to get a signal, which may generate a sound impression as equal as possible to the original sound impression by a flexible use of the section selector and the section signal upmixing means.

The main signal upmixing means may generate an already good sounding main multi channel audio signal, which is improved by the overlay with the section signal upmix.

Artifacts, generated, for example, by separating the input audio signal in a foreground and a background signal may be prevented.

In some embodiments according to the invention, the selected section signal is stored and used several times for upmixing and overlaying to obtain an improved multi-channel audio signal. In this way, the number of section signals in the multi-channel audio signal may be varied. For example, the section signal corresponds to a single raindrop hitting ground. So, the density of single audible raindrops in a rain shower may be varied.

In some further embodiments according to the invention, the input audio signal is analyzed in order to identify the section of the input audio signal. For example, a specific ambience signal, like applause or rain, may be identified, and within these signals, a single clap or raindrop may be isolated.

BRIEF DESCRIPTION OF THE DRAWINGS

Embodiments of the present invention will be detailed subsequently referring to the appended drawings, in which.

DETAILED DESCRIPTION OF THE INVENTION

For simplification, most of the embodiments below mention or show an input audio signal with two channels (N=2) and a generated multi-channel audio signal with five channels (M=5). This corresponds to the common case that two-channel media (for example CDs) should be reproduced by a five-channel system (often a so-called 5.1 home cinema system, wherein the 0.1 stands for an effect channel with reduced bandwidth). However, the described concepts are easily transferable to any numbers of channels or object-oriented reproductions for a person skilled in the art.

Figure 1:
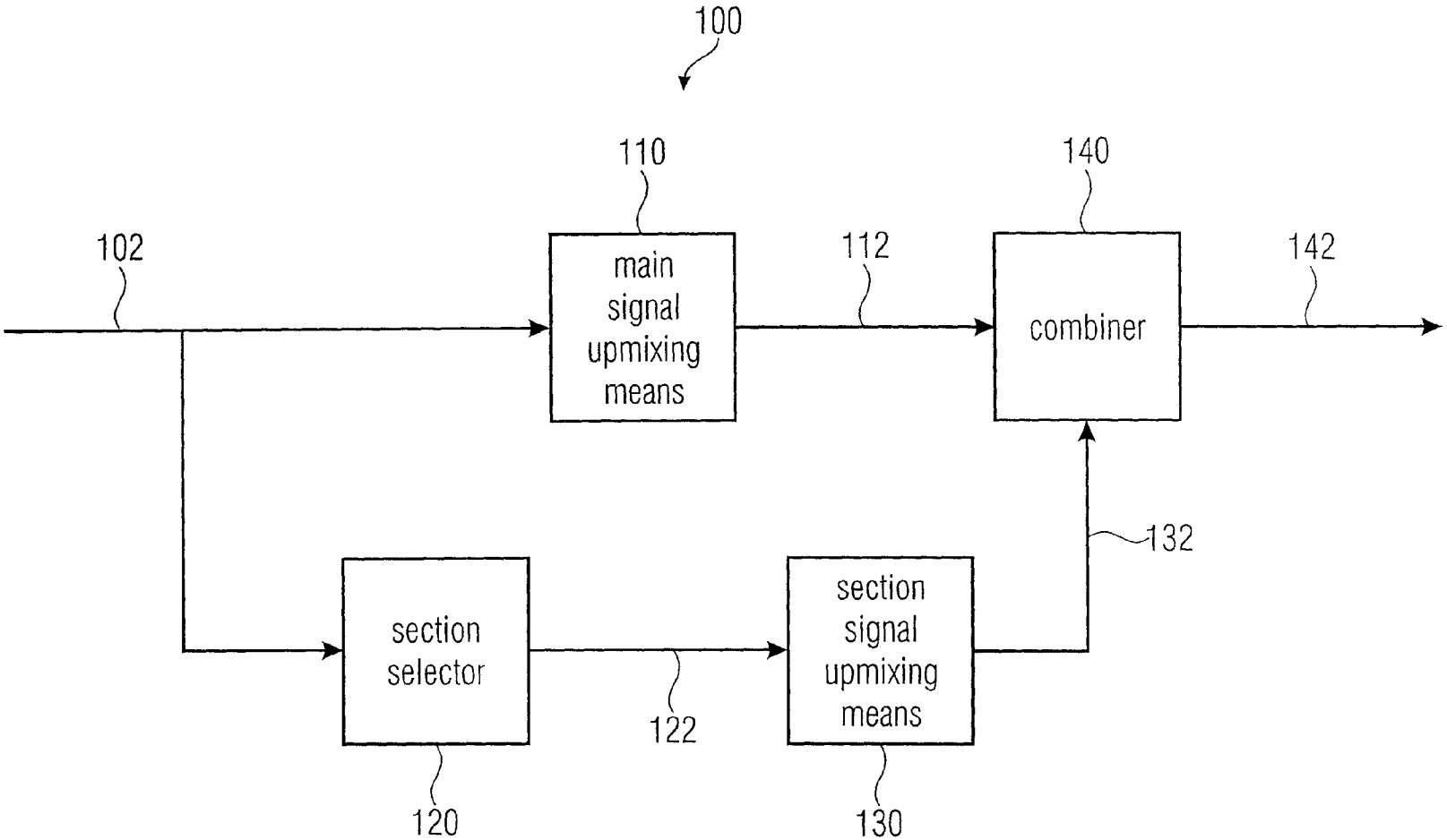
FIG. 1 is a block diagram of an apparatus for generating a multi-channel audio signal.
Figure 2:
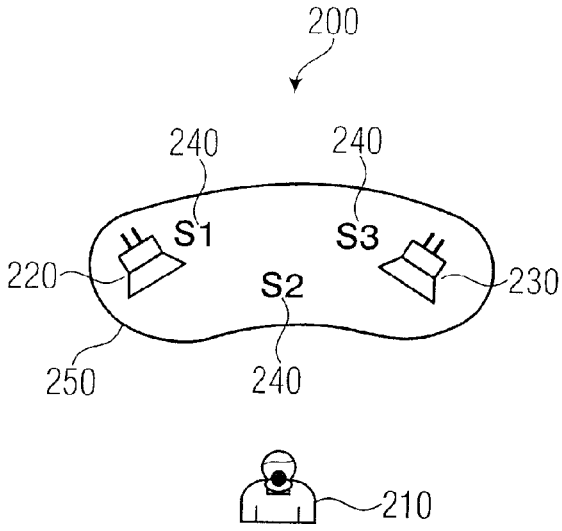
FIGURE 2 PRIOR ART
FIG. 2 is a schematic illustration of an audio signal reproduction of a two-channel system.
Figure 3:
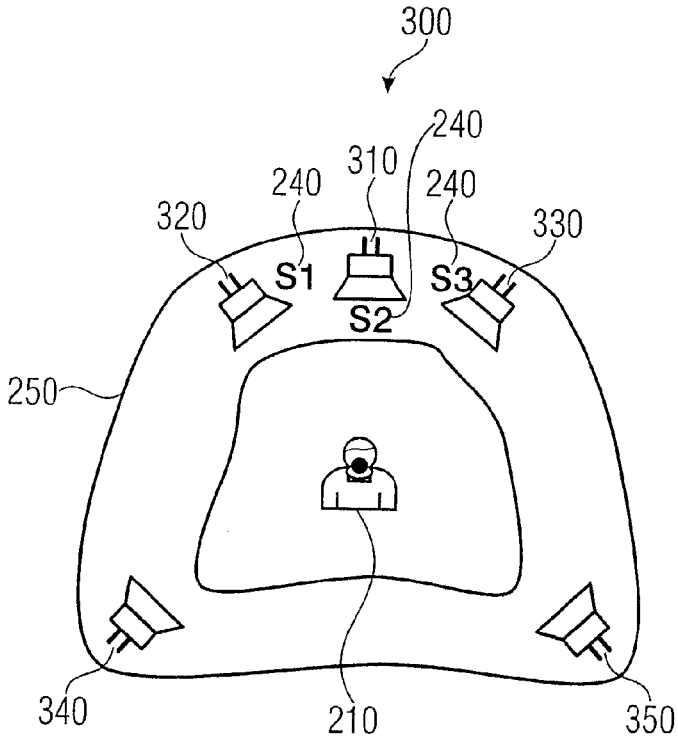
FIGURE 3 PRIOR ART
FIG. 3 is a schematic illustration of an audio signal reproduction of a blind upmix according to the direct ambience concept.
Figure 4:
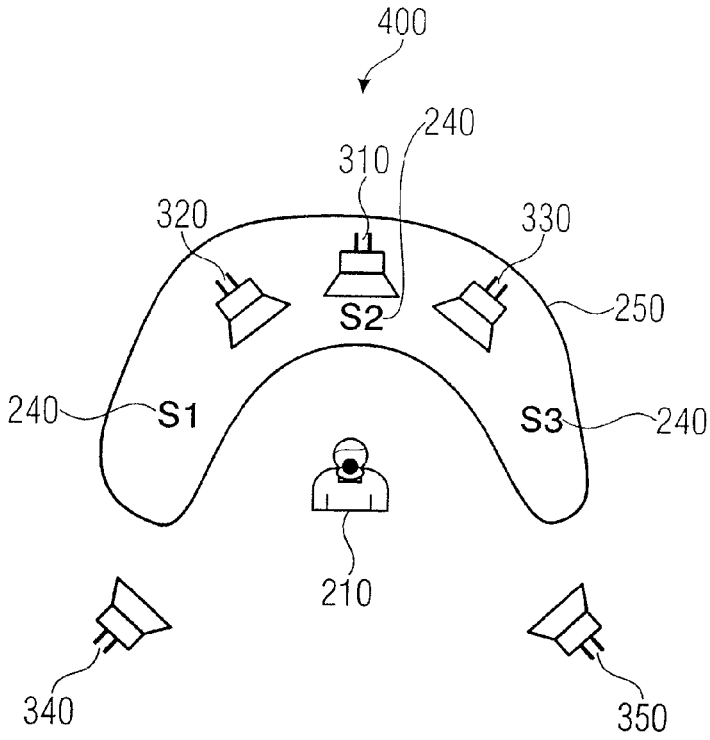
FIGURE 4 PRIOR ART
FIG. 4 is a schematic illustration of an audio signal reproduction of a blind upmix according to the in-the-band concept.

FIG. 1 shows a block diagram of an apparatus 100 for generating a multi-channel audio signal 142 based on an input audio signal 102 according to an embodiment of the invention. The apparatus 100 comprises a main signal upmixing means 110, a section selector 120, a section signal upmixing means 130 and a combiner 140. The main signal upmixing means 110 is connected to the combiner 140, the section selector 120 is connected to the section signal upmixing means 130 and the section signal upmixing means 130 is also connected to the combiner 140.

The main signal upmixing means 110 is configured to provide a main multi-channel audio signal 112 based on the input audio signal 102.

The section selector 120 is configured to select or not select a section of the input audio signal 102 based on an analysis of the input audio signal 102. The selected section of the input audio signal 102, a processed selected section of the input audio signal 102 or a reference signal associated with the selected section of the input audio signal 102 is provided as section signal 122.

The section signal upmixing means 130 is configured to provide a section upmix signal 132 based on the section signal 122.

The combiner 140 is configured to overlay the main multi-channel audio signal 112 and the section upmixing signal 132 to obtain the multi-channel audio signal 142.

For example, a representative section of the input audio signal for a specific ambience, like applause or rain, is selected based on an analysis of the input audio signal. This selected section 122 may be processed or replaced by a reference signal. The selected section 122, the processed selected section or the reference signal is then upmixed and overlaid with the main multi-channel audio signal 112 to obtain an improved multi-channel audio signal 142.

Therefore it may be possible to add, for example, a transient signal in terms of a section upmix signal 132 to the main multi-channel audio signal 112.

The section signal upmix and the overlay may be done in a way so that the multi-channel audio signal 142 may generate an immersive ambience for a listener and therefore an improved multi-channel audio signal.

The main signal upmixing means 110 may work in principle according to any upmix method. In order to obtain a homogeneous ambience-like sound impression in the hearing distance between the front loudspeakers and the surround loudspeakers, all loudspeaker signals and especially the front sound with respect to the surround sound has to be decorrelated. During a blind upmix, for example, only the N input signals are available, from which the new output signals with other properties has to be generated by a weighting of the individual portions of the signals. In this way, for example, the direct sound sources may be emphasized by attenuation of the ambience portion or the other way round.

It can usually be assumed that a common upmix effect would generate an enveloping sound impression for applause-like signals.

The section selector 120 may also be called particle separator and selecting a section of the input signal may also be described by a separation of a particle.

The section selector 120 selects, for example by cutting out, a section of the input signal (which is also called particle or sound snippet), which is typical or characteristic for the input signal. This may be done in different ways.

For example, a short section of the waveform (time domain representation) of the input signal may be cut out.

An alternative may be a selection, optionally a processing and a retransformation of single blocks or a group of blocks from the time frequency domain to the time domain.

A further alternative is marking blocks in the time domain and/or frequency domain, which are especially handled in the following processing and added to the overall signal again just before the retransformation. For example, a temporal section of the input audio signal may be selected and split into a plurality of frequency bands, for example by a filter bank. One or more of the different frequency bands may be processed and then, if necessitated, retransformated and, for example, overlaid with the unprocessed selected section of the input audio signal.

By processing the selected section of the input audio signal, the quality of the sound particle (selected section) may be improved. For example, the clap of a listener of an audience may be isolated by processing of the selected section. The isolated clap may be modified to generate, for example, a better-sounding clap or various slightly different-sounding claps.

A further alternative may be replacing the selected section by a reference signal. For example, the selected section contains a clap of a listener of an audience and is replaced by a reference signal containing an perfect clap.

The combiner 140, for example, adds one or more separated particles contained in one or more section upmix signals to the main multi-channel audio signal (also called default upmix). The main multi-channel audio signal and the section upmix signal may, for example, directly be added or be added with adapted amplitudes and/or phases.

Figure 5:
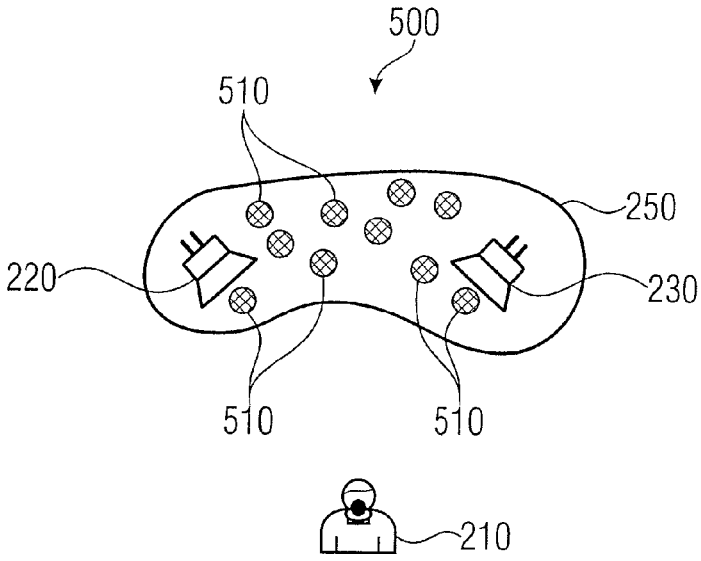
FIG. 5 is a schematic illustration of an audio signal reproduction of an applause-like signal comprising a plurality of single sources.

FIG. 5 shows a schematic illustration of an audio signal reproduction 500 of an applause-like signal comprising a plurality of single sources. This embodiment shows a two-channel system with a left loudspeaker 220 and a right loudspeaker 230 and a plurality of single sources 510, which correspond to the particles, which should be separated, distributed between the two loudspeakers, wherein the position between the two loudspeakers depends on the portion of the signal reproduced by the left loudspeaker and the right loudspeaker.

The section signal upmixing means 130 may generate a section upmix signal 132, which contains, for example, one or more sound particles. This upmixing process may be based on a position parameter, wherein the position parameter, for example, indicates at which position a listener will hear a specific particle. The position parameter may be determined by position information contained by the input audio signal or may be generated randomly by, for example, a random position generator.

The signal portions of a particle in the different channels of the multi-channel audio signal may be determined by an amplitude panning method, for example, based on a position parameter of the particle.

Figure 6:
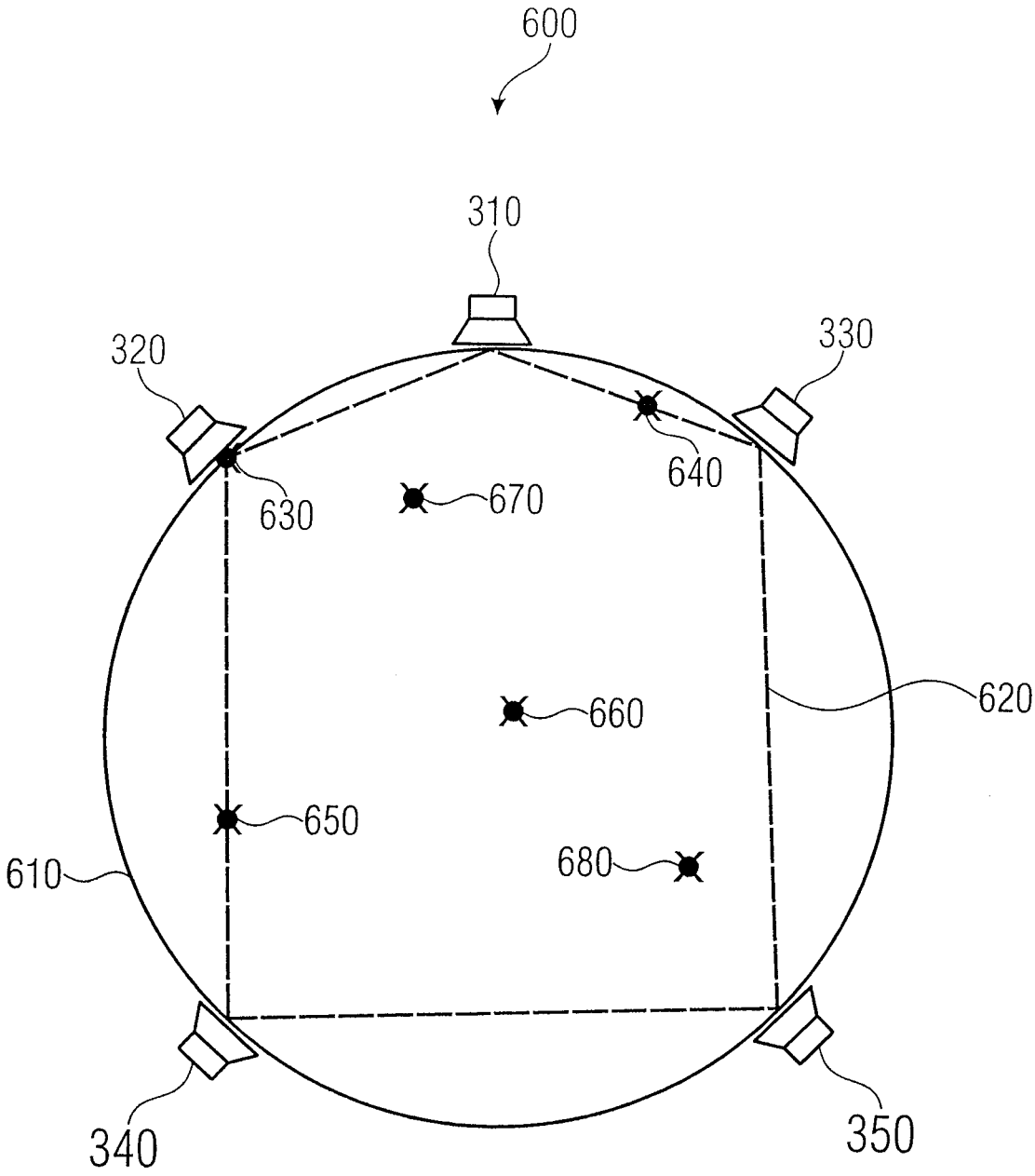
FIG. 6 is a schematic illustration of an influence of the positions parameter to an audio signal reproduction.

FIG. 6 shows a schematic illustration 600 of an influence of the position parameter to an audio signal reproduction. The figure shows five loudspeakers corresponding to a five-channel audio signal. In this example, the loudspeakers are arranged at a circumference 610 of a circle.

When a signal of a sound particle is sent to the loudspeaker, a virtual position at which a listener would hear this specific sound particle depends on the portion of the signal sent to each loudspeaker. For example, when the signal is only sent to one loudspeaker, a listener would think that the sound source is located at this specific loudspeaker. This case is shown for the particle 630 located at the front left loudspeaker 320. If the signal is shared between two loudspeakers, a virtual position of the sound particle would be located between these two loudspeakers. This is shown by particles 640 and 650. A signal approximately equal distributed between the five loudspeakers would appear approximately in the middle of the loudspeaker array, shown at reference numeral 660. In this way, the virtual position of a sound particle may be located at any point (for example shown at reference numeral 670 and 680) within the area bounded by the line 620 between each two neighboring loudspeakers.

A section signal or particle may be added at random positions and/or random times. The section signal upmixing means 130 may also be called particle upmixing means.

This addition may depend on the kind of ambience (applause, rain or others) at static positions, at given paths, or at completely random positions, each with possibly randomly set times.

Some embodiments according to the invention comprise a section signal memory (or intermediate memory or buffer memory). This memory may store single separated particles or section signals, processed section signals or reference signals which may be used several times. To change or vary the sound of the extracted sound particles, a filter or high-quality process steps, as for example the transient forming method described in "M. Goodwin, C. Avendano, "Frequency-domain algorithms for audio signal enhancement based on transient modification", Journal of the Audio Engineering Society 54 (2006) No. 9, 827-840" may be used.

In some embodiments according to the invention, the addition of the section upmix signal to the main multi-channel audio signal, also called the addition of particles to the default upmix, may be controlled by parameters like a density parameter and/or a spreading parameter.

The density parameter, for example, indicates how many single sounds or particles (per time) are added to the main multi-channel audio signal (default upmix). These particles may correspond to different selected sections of the input audio signal or one specific separated particle stored in a memory and used several times.

The spreading parameter, for example, determines in which area of the sound caused by the multi-channel audio signal (upmix sound), the particles should be added to the main multi-channel audio signal (default upmix).

Figure 7:
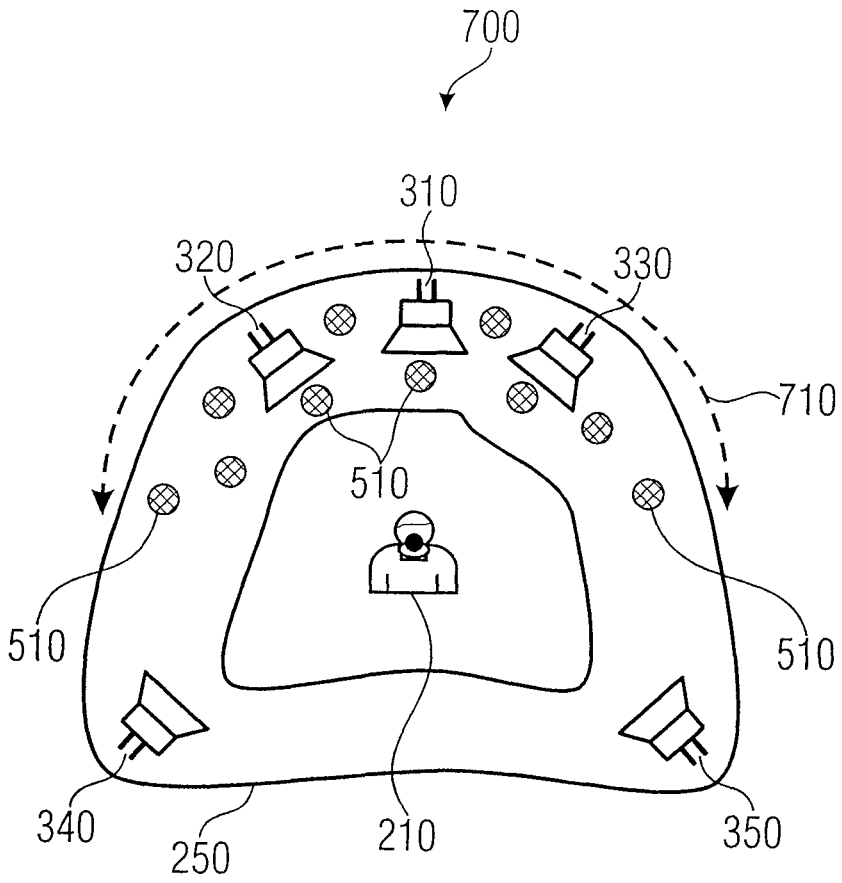
FIG. 7 is a schematic illustration of an influence of the distribution parameter to an audio signal reproduction.

FIG. 7 shows a schematic illustration 700 of an influence of the spreading parameter to an audio signal reproduction. In FIG. 7, the influence of the spreading parameter is indicated by the dashed line 710. For example, for some sound impressions it may be desirable that the particles are only added in front of a listener 210, and for other sound impressions it may be better to spread the particles over the whole area or only at the backside.

The spreading parameter, for example, may influence a random generation of a position parameter for each of a plurality of particles. In the example shown in FIG. 7, the probability for a position of a particle in front of the listener is higher than in the back of the listener.

The density and/or spreading of the ambience may be varied by parameters, for example, also independent from the density and the spreading of the input audio signal.

FIG. 7 shows an example for an upmix of the signals shown in FIG. 5 by applying the described concept.

In some embodiments according to the invention, separated particles are reproduced only by one single loudspeaker to avoid a doubling effect, for example if a delay between different loudspeakers is used.

Some embodiments according to the invention comprise an analyzer, also denoted as classification block, configured to perform the analysis of the input audio signal in order to identify the section of the input audio signal to be selected. The analyzer may be a part of the section selector or an independent separate block.

Figure 8:
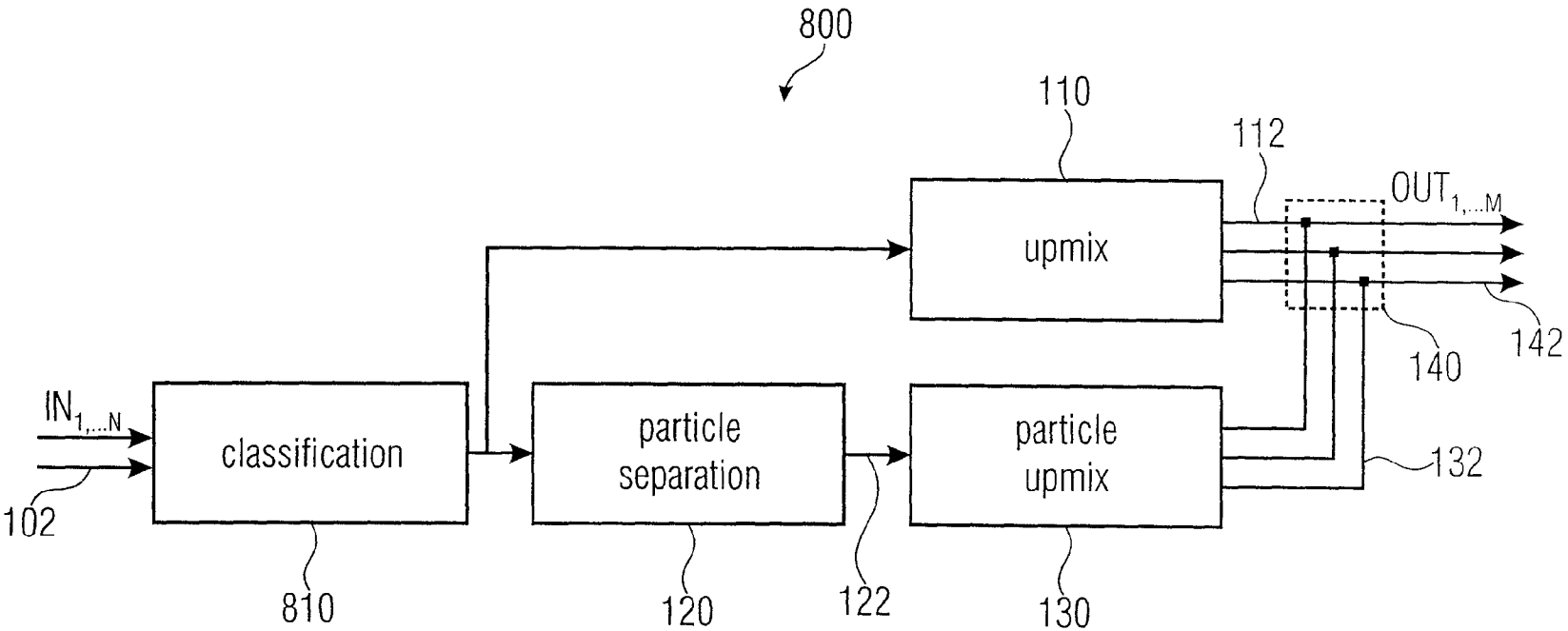
FIG. 8 is a block diagram of an apparatus for generating a multi-channel audio signal.

FIG. 8 shows a block diagram of an apparatus 800 for generating a multi-channel audio signal 142 based on an input audio signal 102 according to an embodiment of the invention. In this case, the analyzer 810 is shown as separate block.

The analyzer 810 may be configured to identify a section to be selected based on an identification parameter contained in the input audio signal, a comparison of the input audio signal with a reference signal, a frequency analysis of the input audio signal or a similar method. For example, in this way an ambience-like signal in the input audio signal may be identified. An example may be an applause detector or a rain detector.

The analyzer 810 or classification unit may decide if the input audio signal or a section of the input audio signal can be processed in the described way. Depending on the results of the analysis or classification, parameter values of the further blocks, for example, the main signal upmixing means, the section selector, the section signal upmixing means or the combiner may be modified.

For example, the analyzer tells the section selector by a (analysis) parameter which section of the input audio signal should be selected, or tells the main signal upmixing means to attenuate the section to be selected in the main multi-channel audio signal.

The combiner 140 shows in this case a direct connection between the output of the main signal upmixing means 110 and the output of the section signal upmixing means 130, which may be one possibility to combine the main multi-channel audio signal and the section upmix signal. An alternative may be an amplitude and/or phase adjustment of the main multi-channel audio signal and/or the section upmix signal.

Some embodiments according to the invention comprises a controller configured to deactivate the section selector, the section signal upmixing means or the combiner. By switching one of these three units from an activated to a deactivated state, the overlay of the main multi-channel audio signal and the section upmix signal is hindered. Therefore, the multi-channel audio signal is basically (for example, except amplitude and phase differences) equal to the main multi-channel audio signal.

An alternative may be that the controller is configured to switch continuously between a fully activated and a deactivated state of the section selector, the section signal upmixing means or the combiner. This may provide the possibility of a continuous fading between two different atmospheres to obtain a more enveloping or immersive sound impression.

The controller may be controlled by a control parameter contained in the input audio signal or controlled by a user interface. This may give a producer (by a control parameter contained in the input audio signal) or a listener (by a user interface) the possibility to adjust the sound impression according to their liking or to instructions.

The controller may provide a continuous fading possibility from an enveloping (may be the default or fallback) to an immersive sound impression or from an immersive to an enveloping sound impression.

In some embodiments according to the invention, selected sections or particles, which appear in the surround signal, may be attenuated in the front signal. This may generated a very discrete felt immersion effect. A temporal shift of the particles compared with the input signal and the reuse of a particle may be impossible then. Only the position may be changed.

In some further embodiments according to the invention, basically a good sounding sound impression is generated by the main signal upmixing means (default upmix), which only represents one characteristic and is upgraded by the separated particles. Therefore, it may be possible that the same input sounds appear in a decorrelated, enveloping portion as well as in the immersive direct portion. This may be possible because, for example, no signal needs to be reproduced, because a new signal is generated anyway by the upmix.

In some embodiments of the invention the temporal sequence of the single elements of the foreground sound may be changed and a transition from an enveloping to an immersive ambience may be possible. Also, an automatic signal classification may be used.

The temporal density of the ambience, the desired timbre and the spatial spreading (in the guided mode) may be set independent of the original signal.

Some embodiments of the invention relate to an section signal upmixing means using an upmixing rule different from an upmixing rule of the main signal upmixing means.

Figure 9:
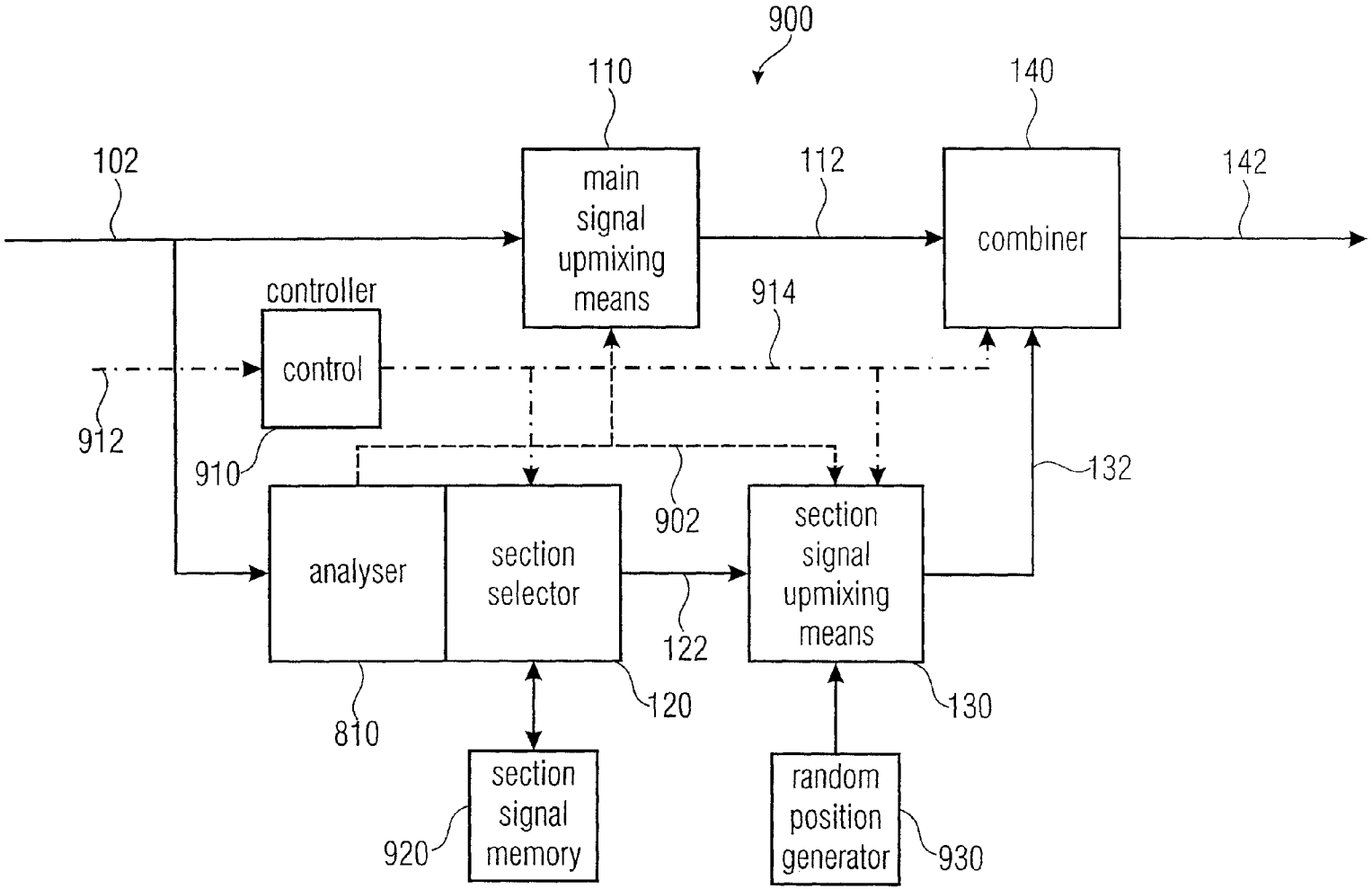
FIG. 9 is a block diagram of an apparatus for generating a multi-channel audio signal.

FIG. 9 shows a block diagram of an apparatus 900 for generating a multi-channel audio signal 142 based on an input audio signal 102 according to an embodiment of the invention.

The apparatus 900 corresponds to the apparatus shown in FIG. 8. However, the analyzer 810 (classification unit) in this example is part of the section selector 120 and an analysis parameter 902 is provided to the main signal upmixing means 110 and/or the section signal upmixing means 130.

Additionally, as alternatively mentioned above, a controller 910, a section signal memory 920 and a random position generator 930 are shown.

The section signal memory 920 in this example is connected to the section selector 120 and is configured to store a section signal 122 provided by the section selector 120 and is configured to provide a stored section signal to the section selector 120. Alternatively the section signal memory 920 may provide a stored section signal directly to the section signal upmixing means 130.

The random position generator 930 is, for example, connected to the section signal upmixing means 130 and configured to provide an random position parameter to the section signal upmixing means 130. Alternatively, the random position generator 930 may be connected to the section selector 120 and may provide a random position parameter when a section signal 122 is selected.

The controller 910 in this example is controlled by the control parameter 912 and is connected (shown at reference numeral 914) to the section selector 120, the section signal upmixing means 130 and/or the combiner 140. The controller 910 may deactivate the section selector 120, the section signal upmixing means 130 and/or the combiner 140.

In general, the described invention may provide a better and more realistic sounding upmix of an applause-like ambience signal or a similar ambience signal with less artifacts.

Figure 10:
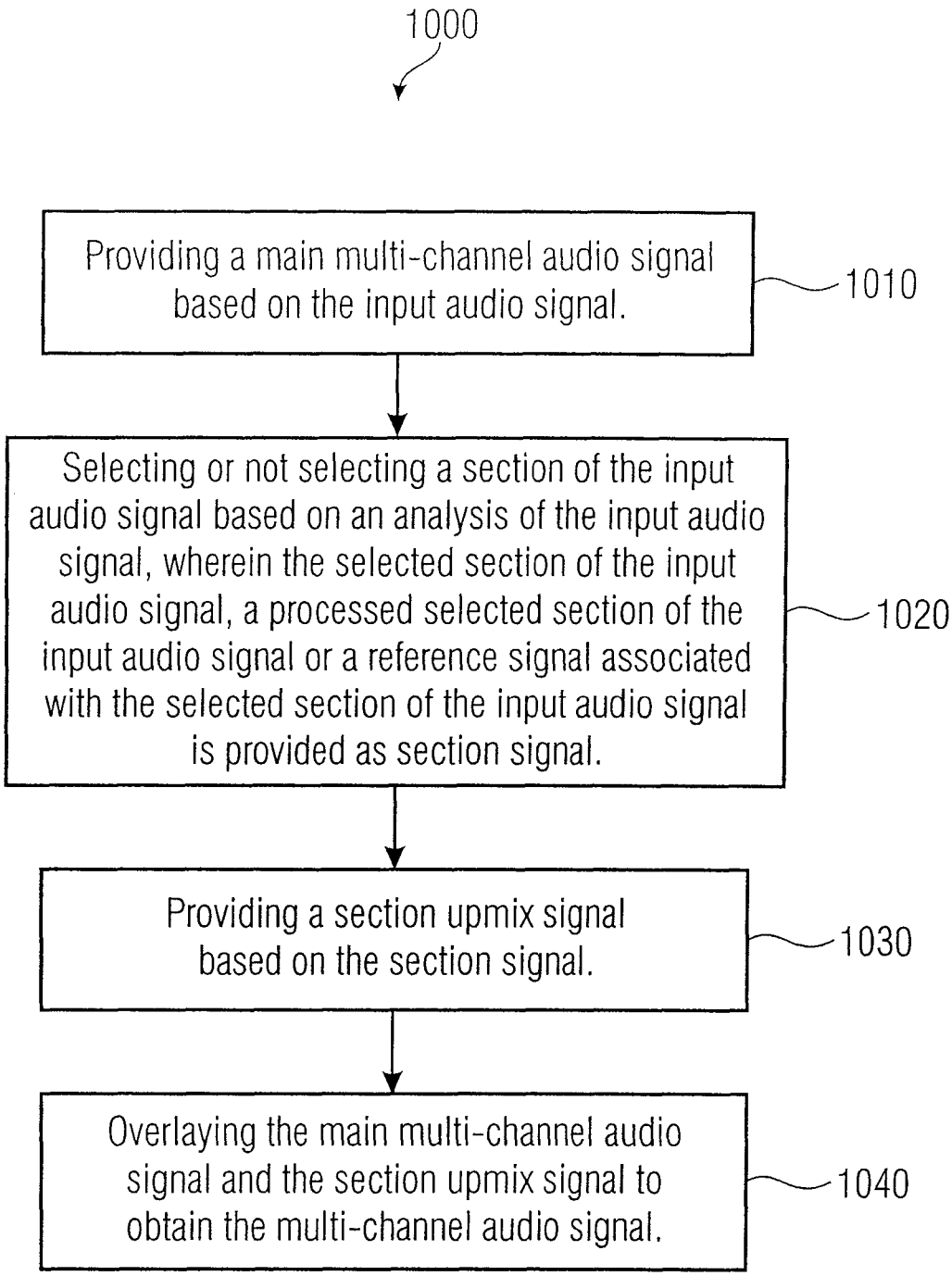
FIG. 10 is a flowchart of a method for generating a multi-channel audio signal.

FIG. 10 shows a flowchart of a method 1000 for generating a multi-channel audio signal based on an input audio signal according to an embodiment of the invention. The method 1000 comprises providing 1010 a main multi-channel audio signal, selecting 1020 or not selecting a section of the input audio signal, providing 1030 a section upmix signal and overlaying 1040 the main multi-channel audio signal and the section upmixing signal.

The provided main multi-channel audio signal is based on the input audio signal.

The selection 1020 of a section of the input audio signal is based on an analysis of the input audio signal, wherein the selected section of the input audio signal, a processed selected section of the input audio signal or a reference signal associated with the selected section of the input audio signal is provided as section signal.

The provided section upmix signal is based on the section signal.

By overlaying 1040 the main multi-channel audio signal and the section upmix signal, the multi-channel audio signal is obtained.

Some embodiments according to the invention relate to a method which provides the possibility for upmixing applause-like sound sources without additional information (unguided upmix) without the conventional artifacts. Additionally, the described method may provide the possibility of a continuous fading between two different concepts to obtain either an enveloping or an immersive sound impression.

Some further embodiments according to the invention relate to a controllable upmix effect.

Some embodiments according to the invention relate to a method providing the possibility to fade between two differently felt impressions of an ambience and/or atmosphere in an upmix, which may be called enveloping ambience and immersive ambience.

Some embodiments according to the invention relate to a main signal upmixing means which is based on a known upmix method. This upmix may be the default working point, if the upmix is not extended by an overlay of a section upmix signal. This may be the case, for example, if a controller deactivates the section selector, the section signal upmixing means or the combiner.

In general, the described concept may be applied also to other signal types than the exemplarily used applause-like signals. For example, it may also be applied to sounds originating from rain, a flock of birds, a seashore, galloping horses, a division of marching soldiers, and so on.

In the present application, the same reference numerals are partly used for objects and functional units having the same or similar functional properties.

In particular, it is pointed out that, depending on the conditions, the inventive scheme may also be implemented in software. The implementation may be on a digital storage medium, particularly a floppy disk or a CD with electronically readable control signals capable of cooperating with a programmable computer system so that the corresponding method is executed. In general, the invention thus also consists in a computer program product with a program code stored on a machine-readable carrier for performing the inventive method, when the computer program product is executed on a computer. Stated in other words, the invention may thus also be realized as a computer program with a program code for performing the method, when the computer program product is executed on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for generating a multi-channel audio signal based on an input audio signal, comprising:

a main signal upmixer configured to provide a main multi-channel audio signal based on all components of the input audio signal, wherein the main multi-channel audio signal comprises more channels than the input audio signal;

a section selector configured to select or not select a section of the input audio signal based on an analysis of the input audio signal, wherein the selected section of the input audio signal, a processed selected section of the input audio signal or a reference signal associated with the selected section of the input audio signal is provided as section signal, wherein the section selector selects a section of the input audio signal by a separation of a sound particle;

a section signal upmixer configured to provide a section upmix signal based on the section signal, wherein the section signal upmixer generates the section upmix signal comprising more than one sound particle; and a combiner configured to overlay the main multi-channel audio signal and the section upmix signal to acquire the multi-channel audio signal, wherein the section signal upmixer is configured to provide the section upmix signal based on a position parameter, wherein a portion of the multi-channel audio signal, which is based on the section signal, for each channel of the multi-channel audio signal is based on the position parameter.

2. Apparatus for generating a multi-channel audio signal according to claim 1, comprising an analyzer configured to perform the analysis of the input audio signal in order to identify the section of the input audio signal to be selected.

3. Apparatus for generating a multi-channel audio signal according to claim 2, wherein the analyzer is configured to identify the section of the input audio signal based on an identification parameter in the input audio signal, a comparison of the input audio signal with the reference signal or a frequency analysis of the input audio signal.

4. Apparatus for generating a multi-channel audio signal according to claim 2, wherein the analyzer provides an analysis parameter, wherein the main signal upmixer provides the main multi-channel audio signal based on the analysis parameter or the section signal upmixer provides the section upmix signal based on the analysis parameter.

5. Apparatus for generating a multi-channel audio signal according to claim 1, comprising a section signal memory configured to store the section signal or a processed section signal, wherein the section signal upmixer is configured to provide a plurality of section upmix signals based on the stored section signal, the stored processed section signal, a modified stored section signal or a modified stored processed section signal.

6. Apparatus for generating a multi-channel audio signal according to claim 5, wherein the section signal upmixer is configured to provide a defined number of section upmix signals based on the stored section signal or the stored processed section signal, wherein the defined number of section upmix signal is determined by a density parameter.

7. Apparatus for generating a multi-channel audio signal according to claim 1, comprising a random position generator configured to generate a random position parameter.

8. Apparatus for generating a multi-channel audio signal according to claim 1, wherein the section signal upmixer is configured to provide the plurality of section upmix signals based on a spreading parameter, wherein each section upmix signal of the plurality of section upmix signals is based on an individual position parameter, wherein the plurality of position parameters are based on the spreading parameter.

9. Apparatus for generating a multi-channel audio signal according to claim 1, wherein the main signal upmixer is configured to attenuate a portion of the input audio signal associated with the selected section of the input audio signal.

10. Apparatus for generating a multi-channel audio signal according to claim 1, comprising a controller configured to deactivate the section selector, the section signal upmixer or the combiner, so that the multi-channel audio signal is equal to the main multi-channel audio signal or is the main multi-channel audio signal, wherein the controller is controlled by a control parameter in the input audio signal or controlled by a user interface.

11. Method for generating a multi-channel audio signal based on an input audio signal, comprising:

providing a main multi-channel audio signal based on all components of the input audio signal, wherein the main multi-channel audio signal comprises more channels than the input audio signal;

selecting or not selecting a section of the input audio signal based on an analysis of the input audio signal, wherein the selected section of the input audio signal, a processed selected section of the input audio signal or a reference signal associated with the selected section of the input audio signal is provided as section signal, wherein selecting a section of the input audio signal is done by a separation of a sound particle;

generating a section upmix signal comprising more than one sound particle based on the section signal;

providing the section upmix signal; and overlaying the main multi-channel audio signal and the section upmix signal to acquire the multi-channel audio signal, wherein the section upmix signal is provided based on a position parameter, wherein a portion of the multi-channel audio signal, which is based on the section signal, for each channel of the multi-channel audio signal is based on the position parameter.

12. A non-transitory computer readable medium including a computer program with a program code for performing the method for generating a multi-channel audio signal based on an input audio signal when the computer program runs on a computer or a microcontroller, the method comprising:

providing a main multi-channel audio signal based on all components of the input audio signal, wherein the main multi-channel audio signal comprises more channels than the input audio signal;

selecting or not selecting a section of the input audio signal based on an analysis of the input audio signal, wherein the selected section of the input audio signal, a processed selected section of the input audio signal or a reference signal associated with the selected section of the input audio signal is provided as section signal, wherein selecting a section of the input audio signal is done by a separation of a sound particle;

generating a section upmix signal comprising more than one sound particle based on the section signal;

providing the section upmix signal; and overlaying the main multi-channel audio signal and the section upmix signal to acquire the multi-channel audio signal, wherein the section upmix signal is provided based on a position parameter, wherein a portion of the multi-channel audio signal, which is based on the section signal, for each channel of the multi-channel audio signal is based on the position parameter.

* * * * *